US009993721B2

(12) United States Patent
Palermo et al.

(10) Patent No.: US 9,993,721 B2
(45) Date of Patent: Jun. 12, 2018

(54) METHOD AND MACHINE OF ENHANCING PLAY OF A SLOT-TYPE GAME WITH EXPANDING TOP SYMBOLS

(71) Applicant: Incredible Technologies, Inc., Vernon Hills, IL (US)

(72) Inventors: James Palermo, Cherry Hill, NJ (US); Daniel John Whelan, Schaumburg, IL (US); Leonid Smikun, Glenview, IL (US)

(73) Assignee: INCREDIBLE TECHNOLOGIES, INC., Vernon Hills, IL (US)

( * ) Notice: Subject to any disclaimer, the term of this patent is extended or adjusted under 35 U.S.C. 154(b) by 274 days.

(21) Appl. No.: 14/828,471

(22) Filed: Aug. 17, 2015

(65) Prior Publication Data

US 2016/0049040 A1 Feb. 18, 2016

Related U.S. Application Data

(60) Provisional application No. 62/037,941, filed on Aug. 15, 2014.

(51) Int. Cl.

| | |
|---|---|
| ***G07F 17/00*** | (2006.01) |
| ***A63F 9/24*** | (2006.01) |
| ***G07F 17/32*** | (2006.01) |

(52) U.S. Cl.

CPC ..... *A63F 9/24* (2013.01); *G07F 17/3244* (2013.01)

(58) Field of Classification Search

CPC ..... G07F 17/00; G07F 17/32; A63F 9/24

See application file for complete search history.

(56) References Cited

U.S. PATENT DOCUMENTS

| | | | | |
|---|---|---|---|---|
| 8,616,953 | B2 * | 12/2013 | Yi | G07F 17/32 463/16 |
| 2009/0286588 | A1 * | 11/2009 | Jackson | G07F 17/34 463/20 |
| 2013/0344933 | A1 * | 12/2013 | Ryan | G07F 17/3209 463/20 |
| 2014/0274295 | A1 * | 9/2014 | Poole | G07F 17/34 463/20 |

* cited by examiner

*Primary Examiner* — Reginald Renwick

(74) *Attorney, Agent, or Firm* — Husch Blackwell LLP; George S. Pavlik

(57) ABSTRACT

A gaming machine and method of play providing a predetermined top game symbol that can replace adjacent symbols to expand possible winning outcomes and payouts for winning outcomes in connection with a "ways to win" game format. The machine and method defining an expanding property applicable to the top symbol, and where the top symbol and expanding property are displayed together in the same game position, the top symbol being propagated to replace other symbols presented on the same reel. A configuration of identical game symbols on displayable game positions of adjacent reels establishing winning outcomes and payouts.

16 Claims, 4 Drawing Sheets

METHOD AND MACHINE OF ENHANCING PLAY OF A SLOT-TYPE GAME WITH EXPANDING TOP SYMBOLS

CROSS REFERENCE TO RELATED APPLICATION

This application claims the benefit of U.S. Provisional Patent Application Ser. No. 62/037,941 filed Aug. 15, 2014, the entirety of which is hereby incorporated by reference as if fully set forth herein.

FIELD

The subject invention pertains generally to an improved electronic gaming machine ("EGM") and method of play, and more particularly to a method and machine for enhancing play by providing a predetermined "top" game symbol that can replace adjacent symbols to expand possible winning outcomes and payouts for winning outcomes.

BACKGROUND

Electronic gaming machines ("EGMs") are generally well known and have been relatively popular, and profitable, for a number of years. Such machines can be configured to offer a variety of casino or entertainment games, including for example, mechanical or electromechanical slot-type matching games, video games or electronic casino games, such as video poker, blackjack, keno, roulette, etc. As is generally known, such machines can accept wagers and compute a random game outcome from a group of potential outcomes. Some random outcomes can include both predetermined winning and non-winning/losing outcomes, with winning outcomes paying a multiple of a wager back to the player and non-winning outcomes paying nothing.

As is generally known, the nature and format of such games have certain limitations with respect to the number and presentation of winning and non-winning outcomes. In particular, the outcome of matching type-slot games is typically determined by evaluating whether certain predetermined configurations of game elements or symbols are selected and presented relative one another. For example, winning outcomes are usually produced when a set of identical symbols are presented in horizontal and/or vertical alignment across the game array. In light of such limitations, the number of possible outcomes, and possible winning outcomes in particular, is largely limited by the random selection of fixed game elements.

It has been recognized that due to such limitations, player interest in such games can decrease over a period of time which may result in certain players discontinuing play of the game and/or declining to play such games again in the future. In settings where players are allowed to place wagers on the outcome of such games and such wagers generate revenue for the establishment or operator, it is generally undesirable to have a game that is not frequently played. Hence, there are on-going needs to try to bring play variations to the audience of players in order to sustain their interest and desire to continue playing.

Accordingly, it is desirable to offer players incentives to continue to play by making them more exciting and/or offering configurations which present the player with greater opportunity and perceived chances of winning. As will be understood by persons of ordinary skill in the art, embodiments presented herein address these objectives.

DETAILED DESCRIPTION

Figure 1:
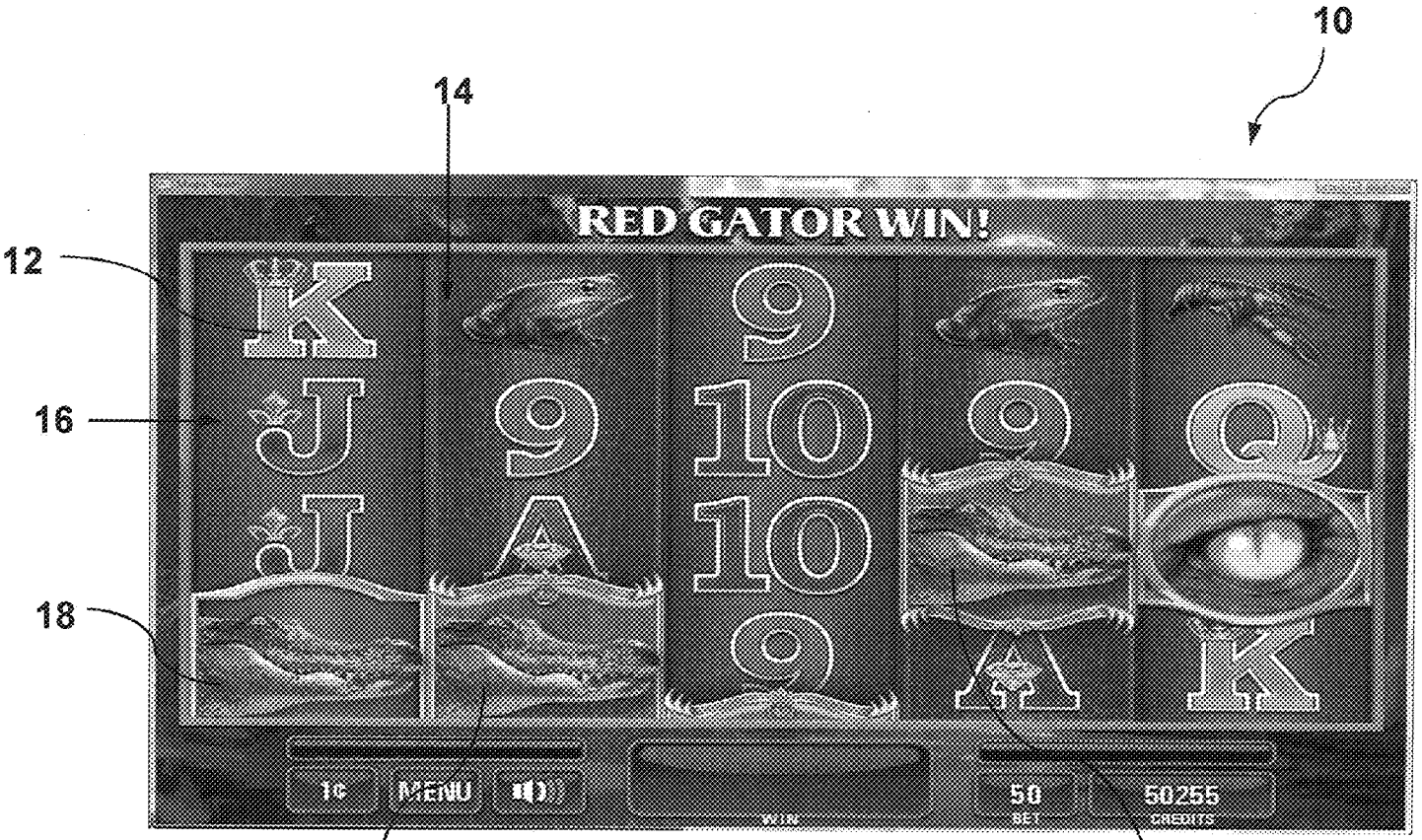
FIG. 1 is a front view of a display screen or portion thereof presenting a first game array according to embodiments disclosed herein.

While the subject invention is susceptible of embodiment in many different forms, there are shown in the drawings, and will be described herein in specific detail, embodiments thereof with the understanding that the present disclosure is to be considered as an exemplification of the principles of the invention and is not intended to limit the invention to the specific embodiments illustrated. For example, although the following disclosure describes embodiments in connection with a traditional slot-type electronic game, it will be recognized that embodiments can also be practiced as part of alternate types of games or game platforms including, for example, online gaming systems played on any electronic device (including, but not limited to, a computer, tablet, or smartphone) that can be connected to an electronic network. It will further be understood that embodiments described herein can be carried out or implemented in connection with games or gaming machines that do not require wagers from a player, such as for example arcade or amusement-type redemption games.

Generally, embodiments of the subject invention relate to a gaming machine and method of play in which a predetermined game element or symbol can trigger substitution of adjacent game symbols or an expansion into adjacent game positions to determine potential winning outcomes in a "ways to win" game format. As used herein, the predetermined game symbol that can trigger such expansion or replacement is referred to as a "top" symbol. From the following, persons of ordinary skill in the art will appreciate that the manifestation of a top symbol can expand and/or enable additional winning outcomes (and payouts) beyond traditional fixed paylines.

The top symbol can be the highest ranked symbol from a population of symbols featured in the game or an alternate symbol selected from outside the population of symbols. The top symbol can additionally be a symbol selected from the population of symbols with an additional or modified element or feature that can make it visually distinguishable from other symbols in the game. According to embodiments of the subject invention, the top symbol can have at least two states, including a non-expanding and expanding state. When the top symbol is in the expanding state, it can replace adjacent game symbols or expand to fill one or more additional symbol positions with symbols matching the top symbol.

According to such embodiments, instead of paying on the configuration of symbols along predetermined "paylines," which typically comprise rows or columns of tangential symbol positions, winning outcomes and associated payouts can be generated according to a number of qualifying "ways to win" which do not require identical game symbols to be aligned in a row across the game array. Thus, in a "ways to win" game, players can win based on the number of horizontally tangent columns containing at least one common symbol.

For ease of illustration, embodiments presented herein will be further described in connection with a displayable game array having five adjacent virtual "reels" or columns with each reel having four game positions or rows. Persons of ordinary skill in the art, however, will understand that game arrays having alternate numbers of reels and/or game positions can be provided without departing from the scope of the subject invention. During play of the game, each game position on each real can be populated with a game symbol or element randomly selected from a predetermined population of game symbols. It will be further recognized that symbols can be fixed at certain game positions on the array at different stages of a game, or that a single play or outcome may not result in a game symbol being populated at each game position.

Table 1 below identifies a sample array using the letters "A," "B," "C," and "D" as game symbols. It will be apparent that the use of such letters is purely exemplary and that a game according to embodiments of the subject invention can include any kind of image, element or symbol that can be visually presented in a displayable game position.

TABLE 1

| | | | | |
|---|---|---|---|---|
| A | A | B | D | A |
| B | B | A | A | D |
| C | C | B | B | D |
| D | A | C | A | D |

In performing the game, each symbol can be assigned a value. For instance, symbol "A" can have a value of 8, and each successive symbol can have a value half as much as the prior symbol, such that the value of B is 4, the value of C is 2, and the value of D is 1. According to this example, the rules of the game provide for winning outcomes to include strings of at least three horizontally tangent columns containing at least one of any given symbol. The rules further provide that a string forming a winning outcome begin at the left-most reel, designated Reel 1, and that a single combination pay the number of horizontally tangent columns containing the common symbol multiplied by the value of the symbol.

In addition, according to such examples, winning outcomes include the longest string of horizontally tangent columns containing identical symbols. However, such outcomes are made for each possible combination of identical symbols forming the longest string. It will be understood that such rules and conditions are not essential to the subject invention and that embodiments disclosed herein can be practiced and/or carried out according to alternate rules or conditions as desired.

According to embodiments presented herein, the payout for each type of symbol can be independent. Thus, ultimately, the payout for each symbol type can be determined by how many unique combinations of identical symbols can be made across horizontally tangent columns. It is preferred, but not required, for longer strings of horizontally tangent columns containing identical symbols to pay higher returns. It is also preferred, but not required, that some minimum number, such as for example a number greater than 1, of horizontally tangent columns containing similar symbols be required in order to receive a return or payout.

Thus, according to the foregoing conditions, the configuration presented in Table 1 above produces the following payout results:

4 combinations of five tangent "A" symbols pays 4×5×8=160 credits 2 combinations of four tangent "B" symbols, pays 2×4×4=32 credits 1 combination of three tangent "C" symbols pays 1×3×2=6 credits Total payout: 198 credits.

For Illustration purposes, one winning combination for each type of symbol is shown below in Tables 1A through 1C:

TABLE 1A

| | | | | |
|---|---|---|---|---|
| A | A | | | A |
| | | A | A | |

TABLE 1B

| | | | | |
|---|---|---|---|---|
| | | B | | |
| B | B | | | |
| | | | B | |

TABLE 1C

| | | | | |
|---|---|---|---|---|
| C | C | | | |
| | | C | | |

Thus, the array of displayed symbols shown in Table 1 can pay 198 credits. It is preferred, but not required, that this payment be subject to being multiplied by some factor related to the amount wagered by a player, such that if the player's wager is increased, the payout amount will be higher and vice versa. For example, a player can be allowed to wager some multiple of the number of positions in the array of displayed symbols. Thus, in the above example, if the player wagered 1×, the payout amount would be 198 credits, if the player wagered 2×, the payout amount would be 396 credits, and up to 10× paying 1980 credits.

According to embodiments presented herein, the foregoing rules and conditions can be carried out in combination with a predetermined top symbol. Thus, a symbol, (e.g. symbol A), can be designated as the top symbol. As indicated above, such top symbol can be presented in either an expanding or non-expanding state. Table 2A below identifies a configuration where expansion-state top symbols A are denoted as "AE" (with non-expansion top symbols represented by "A"):

TABLE 2A

| | | | | |
|---|---|---|---|---|
| A | A | B | D | AE |
| B | B | AE | A | D |
| C | C | B | B | D |
| D | A | C | A | D |

According to embodiments presented herein, expanding top symbols can expand vertically upwards or downwards, or in both directions. Generally, it is preferred, but not required, that top symbols expand in both directions to fill any column (subset of a reel) completely. Applying such conditions to the configuration identified in Table 2A above, results in the following array of displayed symbols presented in Table 2B:

TABLE 2B

| | | | | |
|---|---|---|---|---|
| A | A | A | D | A |
| B | B | A | A | A |
| C | C | A | B | A |
| D | A | A | A | A |

It is further optional, but not required, to pay on the configuration of Table 2A before applying the expanding top symbol rule to arrive at the array of displayed symbols in Table 2B. If this is done, the configuration of the symbols in the symbol positions on the reels, and/or the wager required of the player to begin play, can reflect a "double payment" in order to allow for the control of the ultimate percentage of payout to the player. It is likewise optional, but not required, to pay on all non-top symbol winning configurations, as once the expanding top symbols expand, the number of non-top symbol winning configurations can decrease.

Examining the array of displayed symbols originally shown in Table 2A, the following winning combinations are now present:

64 combinations of five vertically tangent "A" symbols pays 64×5×8=2560

Total Payout: 2560

Because the third column from the left now consists entirely of "A" symbols, no other winning configurations are present. However, despite losing multiple non-top symbol winning combinations, the increase in top symbol winning configurations has increased the player's payout dramatically. Based on the optional multiplier bet configuration set forth above, this array of displayed symbols can result in a payout of anywhere from 2560 credits to 25600 credits.

Figure 2:
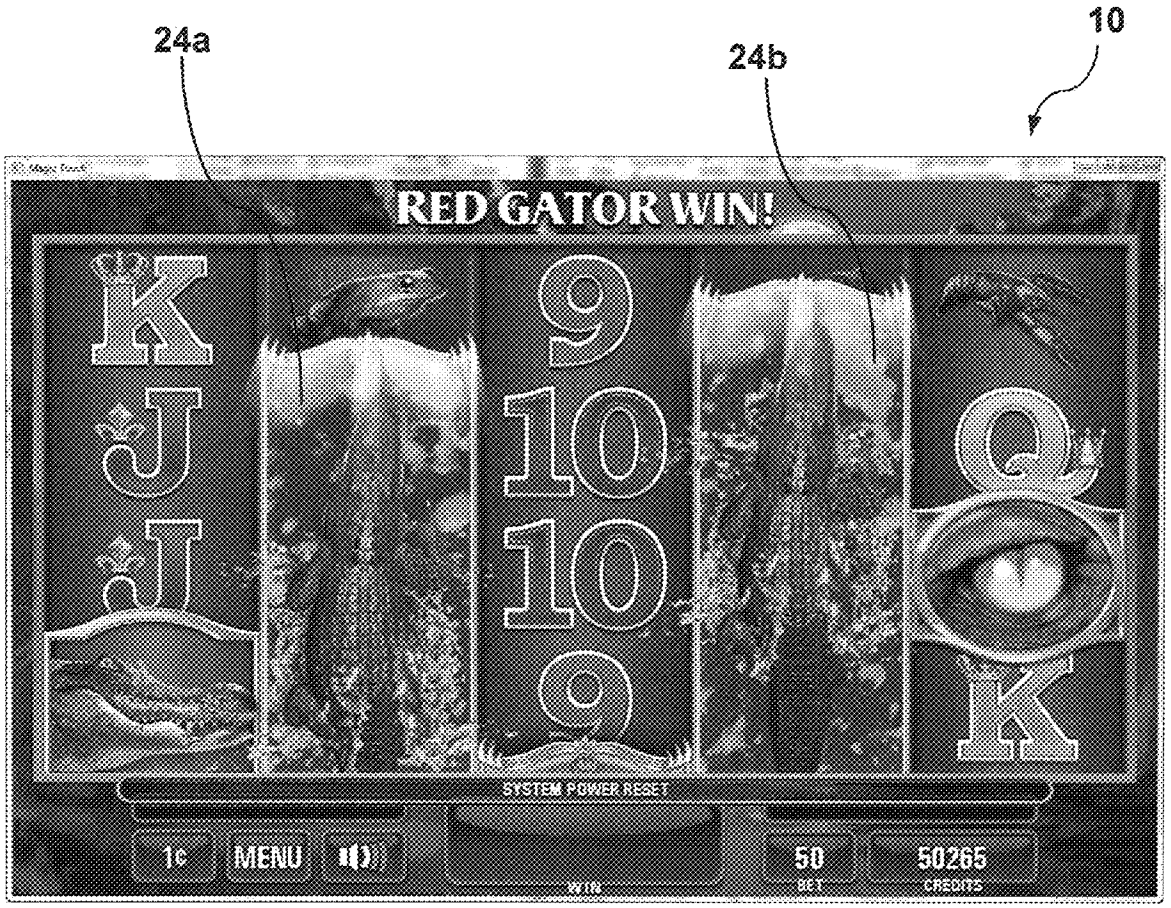
FIG. 2 is a front view of a display screen or portion thereof presenting a second game array according to embodiments disclosed herein.
Figure 3:
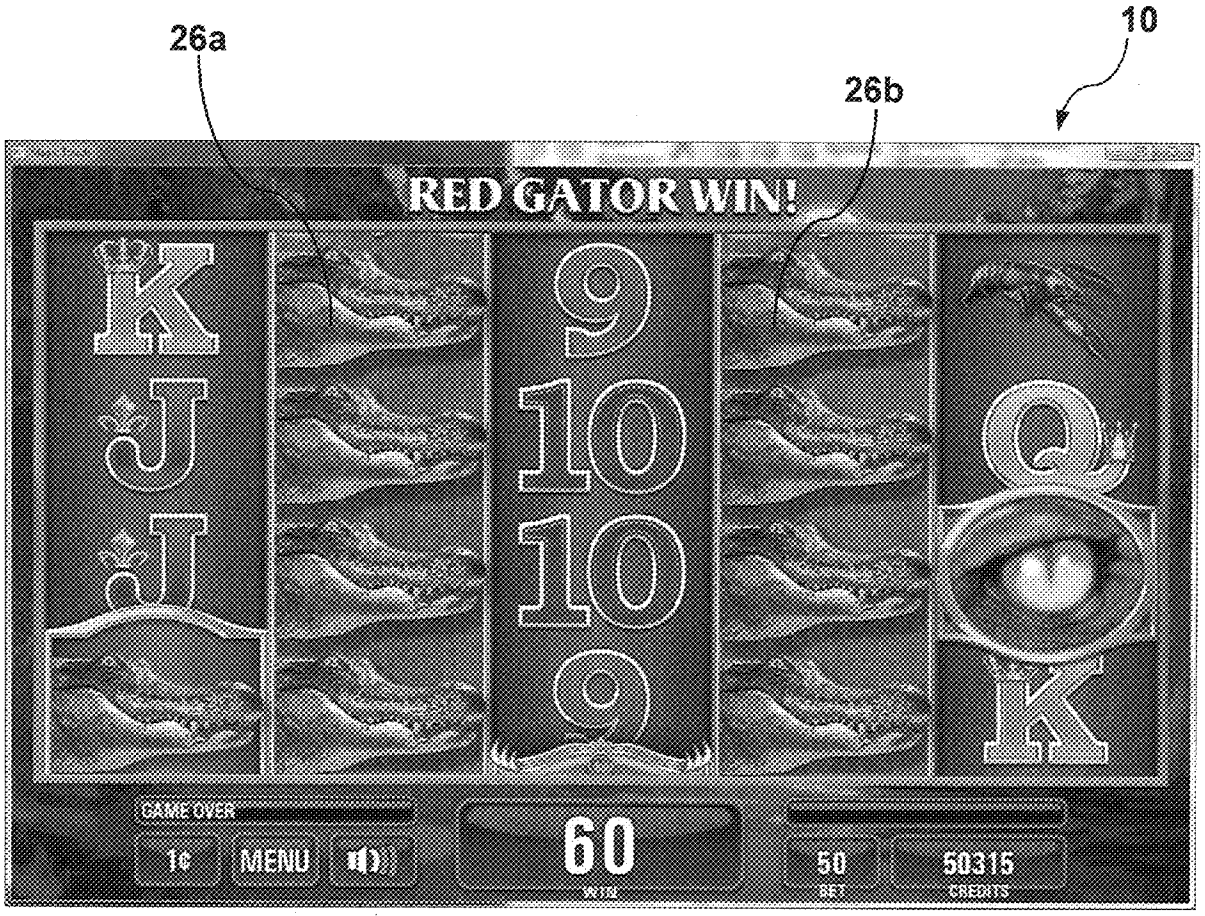
FIG. 3 is a front view of display screen or portion thereof presenting a third game array according to embodiments disclosed herein.

According to embodiments presented herein, top symbols in an expanding-state can visually replace or expand over adjacent symbols. FIGS. 1 through 3 show sample game arrays 10 illustrating the presentation and propagation of expanding-state top symbols. In particular, FIG. 1 illustrates a first array 10 of displayed symbols 12 prior to application of the expanding top symbol. According to such embodiments, the top symbol is designated as a stylized representation of an alligator's head and the properties associated with the expanding state is the red background color, top border with an alligator eye in the middle and top and bottom borders with waved-edges.

Thus, where the reels 14 of FIG. 1 are numbered consecutively from left to right and rows 16 are numbered consecutively from top to bottom, the array 10 of FIG. 1 shows top symbols 18, 20 and 22 on the first reel in the fourth position (18); on the second reel at the fourth position (20), and on the fourth reel at the third position (22). In addition, top symbols 20 and 22 are shown as having features identified above as being indicative of having expanding state properties.

FIGS. 2-3 illustrate the propagation of expanding state top symbols on array 10. In particular, where play of the game results in a configuration with an expanding state top symbols 20 and 22 as shown in FIG. 1, FIG. 2 illustrates that the array 10 can visually present a continuous block 24*a*, 24*b* through static imagery or dynamic animation which can replace or cover adjacent symbols on the same reel. Thus, in FIG. 2, the first and third reels show blocks 24*a*, 24*b* featuring animated alligator crawling over the symbols that were previously displayed on those reels.

Such blocks 24*a*, 24*b* can be accompanied by additional graphics and/or audio sounds or music that can assist in alerting a player as to the manifestation of an expanding top symbol. In addition, blocks 24*a*, 24*b* can remain in place for a predetermined period of time, until the game provides indication of a winning outcome and/or provides an award, or through successive plays of the game.

FIG. 3 illustrates another option for visually presenting expanding state top symbols on an array 10. In particular, symbols located on the same reel as an expanding state top symbol 20, 22 can be visually replaced or substituted with substantially identical individual symbols 26*a*, 26*b* at each individual game position on the reel. Such replacement symbols 26*a*, 26*b* can be static images or can have animated properties as desired. The individual symbols 26*a*, 26*b* illustrated in FIG. 3 can additionally replace a large block symbols 24*a*, 24*b* illustrated in FIG. 2 so that the player can more easily envision the combinations of symbols which have been created.

According to embodiments presented herein, the array 10 can visually display the expansion of an expanding top symbol 20, 22 regardless of whether the play has resulted in a winning outcome or payout. Alternatively, array 10 can visually expand an expanding state top symbol 20, 22 only where the play has resulted in the formation of a winning outcome or payout, or where the expanding state top symbol 20, 22 contributes to a winning outcome or payout.

Figure 4:
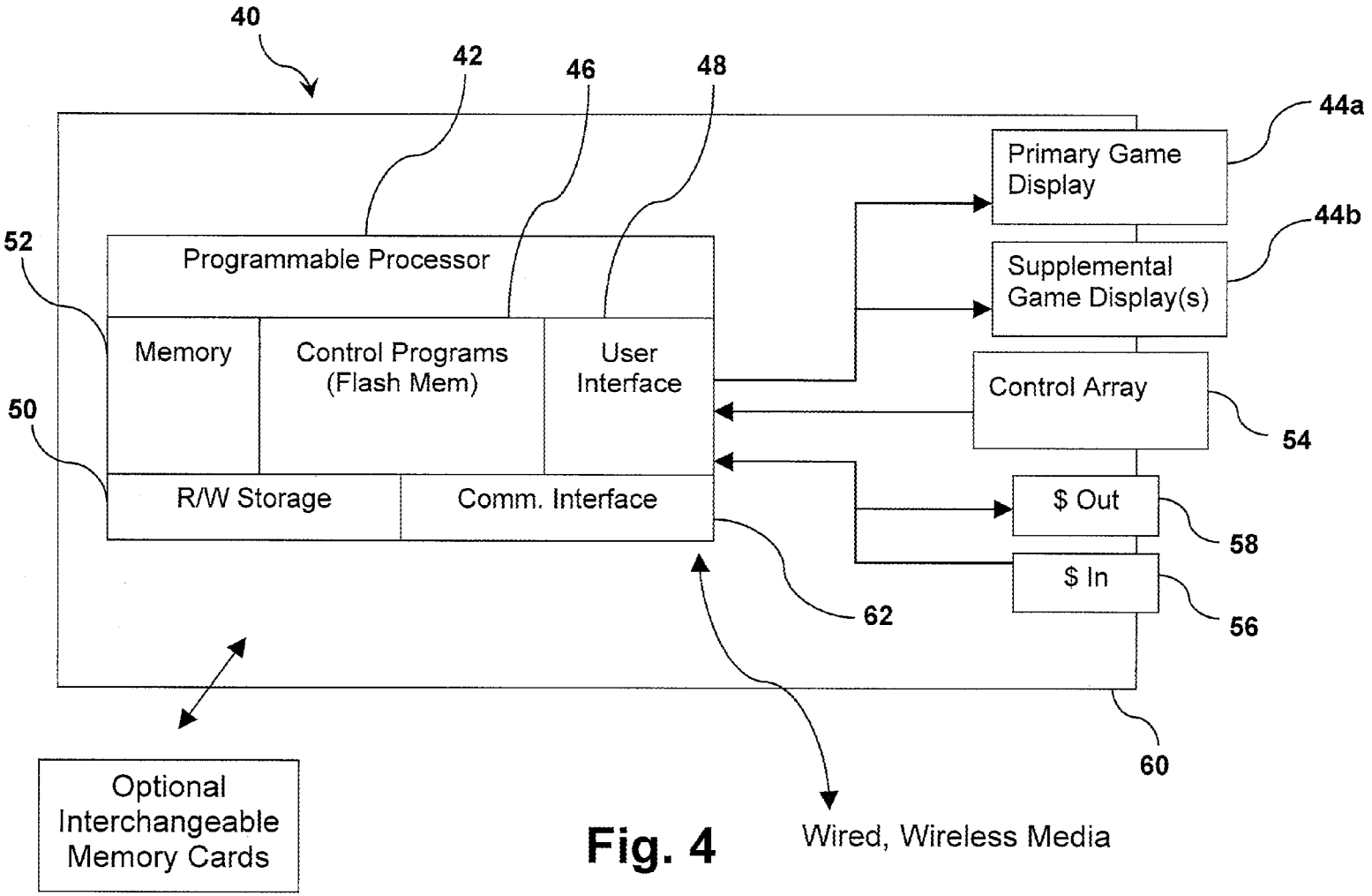
FIG. 4 is a block diagram illustrating elements of an electronic gaming machine ("EGM") according to embodiments of the subject invention

FIG. 4 illustrates elements of an electronic gaming machine ("EGM") 40 according to embodiments of the subject invention. Such EGM 40 can include a programmable processor 42 such as a microprocessor or microcontroller and associated control circuitry that can execute control programs 46 stored, for example, on a transitory or non-transitory computer-readable medium or storage unit 50.

The processor 42 can be operatively coupled to one or more game displays 44*a*, 44*b* and a user interface 48 with input/output circuits. The processor 42 can also include memory 52 which can include a main memory containing dynamic information processed during execution of the game program, and/or a static memory which contains fixed information, such as, for example, an operating system, game programs, and a configuration of information necessary for the processor 42 to register and execute input from a player through a control array 54.

The processor 42 can execute the control programs 46 to perform primary functions for play the game, such as for example, randomly selecting game outcomes from a plurality of possible outcomes, recognizing a particular outcome as a predetermined winning or non-winning outcome and/or determining a reward amount associated with a particular winning outcome. The processor 42 can additionally control the game displays 44*a*, 44*b* by generating static or dynamic video for presentation thereon.

Displays 44*a*, 44*b* can include any kind of electronic display device suitable for visually electronically presenting dynamic video images or graphics of a game played on the EGM 40. The displays 44*a*, 44*b* can be CRT, LCD, plasma or LED display devices or monitors and can be physically enclosed in the same housing or cabinet 60 as the processor 42 or can be a located outside the cabinet 60 and be operatively coupled to the processor 42. The displays 44*a*, 44*b* can additionally include touch screen capabilities for receiving input from a player.

The control array 54 can include one or more player input devices, such as for example, a keyboard, mechanical lever, a touch-screen, push buttons or pads and/or any other means for control, or desired combination of controls, able to accept input from a player and produce output to the game display 44*a*, 44*b* in response to a player's input. Where embodiments of the subject invention are practiced or provided in connection with a wagering game, the gaming machine 40 can further include a credit input device 56, such as for example a coin or bill acceptor or card reader, and a payout device 58, including for example, a coin, bill or ticket dispenser or an electronic I/O interface which can electronically load credits or awards to a player card or other personal electronic storage device. The credit input device 56 and payout device 58 can be operatively connected to the processor 42 and when money or other credits are deposited in connection with a game, the control program 46 can instruct the payout device to issue an award in response to the selection of certain predetermined winning outcomes of the game. The reward or payoff can be provided in any form, including for example, coins, bills, credits, points, cards, tickets or coupons.

The gaming machine 40 can additionally feature a communication device for electrically transmitting information, including control signals, game data or detected conditions to a remote electronic device such as for example, a computer, network or display device, dedicated storage device, or other mobile electronic device such as a PDA, smart phone, notebook computer or electronic tablet. Such communication device can include a communication interface 62 that can electronically communicate information between the EGM 40 and an external or remote electronic device though a private or public data network via wired or wireless communication.

As will be understood by those of ordinary skill in the art, while the description above details the preferred and best mode(s) of practicing the invention, many other configurations and variations are possible. For example, the invention need not be practiced with a commercial/regulated gaming system, but could be used with a variety of coin-operated amusement devices, home gaming systems, or any other appropriate system. Accordingly, the scope of the invention should be determined not by the embodiment(s) illustrated, but by the claims below and their equivalents.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims. Further, any steps or actions referenced above or in the accompanying figures do not require the particular order shown, or sequential order, to achieve desirable results. Other steps may be provided, or steps may be eliminated, from the described methods, and other components may be added to, or removed from the described embodiments.

What is claimed is:

1. A gaming machine comprising:

a programmable processor and control circuitry;

an electronic display operably connected to the processor, the display being configured to present a game array featuring a plurality of virtual reels in association with a game played on the gaming machine, each reel having a plurality of displayable game positions, each of the displayable game positions configured to display at least one game symbol from a population of game symbols;

a control unit operably connected to the processor capable of accepting a wager and a plurality of game control inputs from a player;

a storage unit operably connected to the processor, the storage unit containing a plurality of instructions for execution by the processor and control circuitry;

a game symbol from the population of game symbols being designated as a top symbol, the top symbol having a greater value than a value of any other symbol in the population of game symbols and being configured for display on the game array in at least one of an expanded or non-expanded state;

an expanding property configured for being randomly populated at a displayable game position of the plurality of displayable game positions;

during play of the game, the array of displayable game positions being randomly populated with game symbols from the population of game symbols and the expanding property being randomly populated in displayable game positions in association with the randomly populated game symbols, and where a displayable game position of the plurality of displayable game positions has been randomly populated with both a top symbol and an expanding property, the top symbol in said displayable game position being converted from the non-expanded state to the expanded state and game symbols randomly populated at other displayable game positions on the same reel as the expanded state top symbol being replaced with the expanded state top symbol;

the symbols presented in the displayable game positions including any expanded state top symbols being evaluated according to a fixed set of rules, the fixed set of rules defining at least one winning configuration of symbols and at least one losing configuration of symbols; and where the symbols presented in the displayable game positions correspond to a winning configuration of symbols, a prize being awarded corresponding to the winning configuration of symbols.

2. The gaming machine of claim 1 further comprising a virtual block visually presented on the array, the block comprising dynamic animated graphics covering randomly populated symbols on the reel.

3. The gaming machine of claim 1 where a winning configuration of game symbols comprises identical symbols visually presented on a displayable game position on at least three adjacent reels.

4. The gaming machine of claim 1 where the control unit comprises a keyboard, mechanical lever, button or touchscreen.

5. The gaming machine of claim 1 where the electronic display is a CRT, LCD, plasma or LED display.

6. The gaming machine of claim 1 further comprising a cabinet for housing the processor, control unit, and storage unit.

7. The gaming machine of claim 1 further comprising a communication interface coupled to the computer, the communication interface suitable for electronically transferring information between the computer and other electronic devices via electronic signals.

8. The gaming machine of claim 1 further comprising a wager input device and an award payout device.

9. The gaming machine of claim 1 where a top symbol in a non-expanded state changes appearance on the electronic display upon being converted to the expanding state.

10. A gaming machine comprising:

an electronic display operably connected to a programmable processor, the electronic display being configured to visually present a game array featuring a plurality of virtual reels in association with a game played on the gaming machine, each reel having a plurality of displayable game positions, each of the displayable game positions configured to display at least one game symbol from a population of game symbols;

a game symbol from the population of game symbols being designated as a top symbol being configured for display on displayable game positions of the game array in at least one of an expanded or non-expanded state;

an expanding property configured for being randomly populated at a displayable game position of the plurality of displayable game positions;

during play of the game, the array of displayable game positions being randomly populated with game symbols from the population of game symbols and the expanding property being randomly populated in displayable game positions in association with the randomly populated game symbols, and where an expanding property has been randomly populated in a single displayable game position together with a top symbol in a non-expanded state, said top symbol in the non-expanded state being converted to the expanded state and game symbols randomly populated at other of the plurality of displayable game positions on the same reel being replaced with the expanded state top symbol.

11. The gaming machine of claim 10 wherein replacement of game symbols on a virtual reel with an expanded state top symbol further comprises the plurality of displayable game positions on said reel being virtually merged together to display a single game position spanning the virtual reel.

12. The gaming machine of claim 11 wherein an expanded top symbol displayed at one of the plurality of displayable game positions merged together to form a single game position are virtually replaced with dynamic animation.

13. The gaming machine of claim 10 wherein an outcome from the game is determined only after any conversion of top symbols.

14. The gaming machine of claim 10 wherein the expanding property does not comprise a game symbol from the population of game symbols.

15. The gaming machine of claim 10 wherein random population of the expanding property at displayable game positions on the array is accompanied by visual indication.

16. The gaming machine of claim 10 where such visual indication is presented at the single displayable game position together the top symbol in a non-expanded state.

* * * * *